US008397749B2

(12) United States Patent
Neto et al.

(10) Patent No.: US 8,397,749 B2
(45) Date of Patent: Mar. 19, 2013

(54) PISTON COOLING JET WITH TRACKING BALL ORIFICE

(75) Inventors: Jose Correa Neto, Rochester, MI (US); Truman Allen Potter, Jr., Lake Orion, MI (US); George Lanni, Novi, MI (US)

(73) Assignee: Metaldyne Company LLC, Plymouth, MI (US)

( * ) Notice: Subject to any disclaimer, the term of this patent is extended or adjusted under 35 U.S.C. 154(b) by 1197 days.

(21) Appl. No.: 12/231,950

(22) Filed: Sep. 8, 2008

(65) Prior Publication Data

US 2010/0001103 A1 Jan. 7, 2010

Related U.S. Application Data

(60) Provisional application No. 60/967,885, filed on Sep. 7, 2007.

(51) Int. Cl.
*F16K 15/04* (2006.01)
*F01P 1/04* (2006.01)

(52) U.S. Cl. ..... 137/539; 123/41.35

(58) Field of Classification Search ..... 137/539, 137/539.5; 123/41.35
See application file for complete search history.

(56) References Cited

U.S. PATENT DOCUMENTS

| | | | | | |
|---|---|---|---|---|---|
| 1,104,201 | A | * | 7/1914 | Lenzi | 137/539.5 |
| 1,572,464 | A | * | 2/1926 | Bjorklund | 137/539 |
| 1,638,281 | A | * | 8/1927 | Winslow et al. | 137/539 |
| 1,735,230 | A | * | 11/1929 | Brand | 137/539 |
| 1,931,637 | A | * | 10/1933 | Wahl | 137/539 |
| 1,999,693 | A | | 4/1935 | Hill | |
| 2,069,153 | A | * | 1/1937 | Konkle | 137/539 |
| 2,699,179 | A | * | 1/1955 | Hansen et al. | 137/539 |
| 2,742,054 | A | * | 4/1956 | Poundstone | 137/539 |
| 2,800,119 | A | | 7/1957 | Schmidl | |
| 3,365,648 | A | | 1/1968 | Benjamin | |
| 3,480,113 | A | | 11/1969 | Pope et al. | |
| 3,485,324 | A | | 12/1969 | Novak | |
| 3,709,109 | A | * | 1/1973 | Howe | 123/41.35 |
| 3,827,255 | A | * | 8/1974 | Kish | 137/539.5 |
| 3,894,556 | A | | 7/1975 | Pareja | |
| 4,333,497 | A | * | 6/1982 | Busquets | 137/539 |
| 4,365,648 | A | | 12/1982 | Grothe | |
| 4,862,838 | A | * | 9/1989 | Hodgkins et al. | 123/41.35 |
| 4,869,211 | A | | 9/1989 | Heberle et al. | |

(Continued)

FOREIGN PATENT DOCUMENTS

| | | |
|---|---|---|
| JP | 03-168317 | 11/2001 |
| JP | 2003184549 | 7/2003 |

OTHER PUBLICATIONS

Writ. Opinion Int'l Search, Aug. 25, 2004, Metaldyne Company.

(Continued)

*Primary Examiner* — John Rivell
(74) *Attorney, Agent, or Firm* — McDonald Hopkins LLC

(57) ABSTRACT

An oil jet assembly includes a body, a tube, a cap insert, a ball, and a spring. The body includes a bore passing longitudinally through the body; a tube aperture passing through the body near a first end of the body; and an opening at a second and opposite end of the body. The tube is attached to the body and in fluid communication with the tube aperture. The cap insert is positioned within the bore of the body. The cap insert includes a bore that passes longitudinally through the cap insert to form a wall. The cap insert also includes an oil exit aperture passing though the wall and is in fluid communication with the bore of the body. The ball and spring are positioned within the bore of the insert cap. The spring is positioned between the ball and the first end of the body.

14 Claims, 10 Drawing Sheets

U.S. PATENT DOCUMENTS

| | | | | |
|---|---|---|---|---|
| 4,995,346 | A | 2/1991 | Hudson, Jr. | |
| 5,533,472 | A | 7/1996 | Sands et al. | |
| 5,573,033 | A * | 11/1996 | Litzel | 137/512.3 |
| 5,881,684 | A | 3/1999 | Bontaz | |
| 5,967,180 | A | 10/1999 | Yates, III | |
| 6,672,262 | B2 | 1/2004 | Bontaz | |
| 6,840,270 | B2 | 1/2005 | Yu et al. | |
| 6,866,011 | B1 * | 3/2005 | Beardmore | 123/41.35 |
| 7,104,225 | B2 * | 9/2006 | Bontaz | 123/41.35 |
| 7,559,296 | B2 * | 7/2009 | Perotto | 123/41.35 |
| 2005/0072476 | A1 | 4/2005 | Neto | |
| 2006/0169332 | A1 * | 8/2006 | Ikegawa | 137/539 |
| 2006/0243226 | A1 * | 11/2006 | Bontaz et al. | 123/41.35 |

OTHER PUBLICATIONS

Writ. Opinion Int'l Search, Dec. 21, 2005, Metaldyne Company.

* cited by examiner

PISTON COOLING JET WITH TRACKING BALL ORIFICE

CROSS-REFERENCE TO RELATED APPLICATIONS

This application claims priority from U.S. Provisional Patent Application No. 60/967,885 entitled "PISTON COOLING JET WITH TRACKING BALL ORIFICE" filed on Sep. 7, 2007, which is hereby incorporated by reference in its entirety.

FIELD OF THE INVENTION

The present invention relates generally to fluid jets for providing fluid under pressure to a desired location, and more particularly, to a fluid jet having a stable ball valve assembly.

BACKGROUND OF THE INVENTION

Pistons used in gasoline engines, diesel engines, and high performance engines become easily overheated during operation. Pressure actuated oil jets have been used to cool the under side of pistons in such reciprocating engines. Oil jets are often mounted in a bore on the underside of the engine block and receive oil under pressure from an oil gallery. These oil jets also incorporate a check valve to supply oil to the oil jet when a predetermined oil pressure is achieved. Oil jets also prevent siphoning off of needed oil pressure during low oil pressure conditions.

Oil jets spray oil into cooling channels on the underside of pistons, cooling the piston crowns and surrounding cylinder wall by absorbing heat, thus lowering combustion chamber temperatures. This cooling process occurs as the engine is running to reduce piston temperatures, which helps the engine generate more power and assists in lubricating the piston and cylinder wall to increase durability. The extra oil layer on the cylinder bores and reciprocating components also minimizes noise that is typically generated by such components. Keeping an engine running at desired operating temperatures also enhances the life of critical engine parts and reduces maintenance costs over the lifetime of an engine.

There are two standard types of pressure actuated oil jets used in the industry, each comprising a two-part configuration. As shown in FIG. 1, typical pressure actuated oil jets comprise a two-piece construction comprising an oil jet body 10 and an oil jet valve 12. The oil jet body 10 comprises a main body 14 having a valve aperture 16 at one end and a bolt-receiving aperture 18 at the other end. Extending from the sides of the main body 14 are two nozzles 20 which are in fluid communication with the interior of the valve aperture 16.

The valve 12 generally comprises a tubular sleeve 22 having a threaded exterior portion 24 and a pair of oil exiting apertures 26. The sleeve 22 is further connected to an oversized head 28 at one end. When assembling such a two-piece oil jet assembly, the valve 12 is inserted into the valve aperture 16 until the oil exiting apertures 26 of the valve 12 line up with the nozzles 20. The threaded portion 24 of the valve 12 threadedly engages a threaded bore in the lower portion of the engine block and transfers oil under pressure from the oil gallery to the valve 12.

There are generally two valve constructions used in the industry to handle pressure actuation: a ball valve construction (shown in FIG. 1A), and a piston valve construction (shown in FIG. 1B). While both constructions are further described below, it should be understood that for simplicity, like elements are identified by like numbers.

As best shown in FIG. 2, a ball valve 30 comprises a tubular sleeve 32 connected at one end to an oversized head 40. The sleeve 22 further includes a pair of oil exiting apertures 36 that communicate with the nozzles of an oil jet body when the ball valve 30 is placed within a valve body. A bore 38 extends through the head 40 and sleeve 32 to form a passage for oil to enter the ball valve 30. At the end opposite the head 40, the bore 38 tapers to create a seat 42 that is in fluid communication with an oil entrance opening 44.

A spring 46 is held within the bore 38 and biases a ball 48 against the seat 42. When the ball 48 is in contact with the seat 42, the valve is in the closed position. A cap 50 is placed over the bore 38 at the head 40 to retain the spring 46 within the sleeve 32. When the oil pressure is above a predetermined value, the pressurized oil passes through the oil entrance opening 44 and overcomes the spring force to depress the spring 46 and move the ball 48, thereby opening the valve. The pressurized oil enters the bore 38 and exits at the oil exiting openings 36 as indicated by the arrows X and Y in FIG. 2. The oil exiting apertures 36 are in fluid communication with the nozzles in an oil jet body. Therefore, oil exiting the ball valve 30 is directed to the pistons for cooling and lubrication.

When the oil pressure falls below a predetermined value, the spring 46 biases the ball 48 against the seat 42 to close the valve 30. Once the valve is closed, the pressurized oil no longer flows into the valve 30 and pressurized oil is seals and prevents pressure from siphoning off. The valve remains in this state until the pressure once again rises above the predetermined level and overcomes the biasing force of the spring 46.

While cost effective and less susceptible to sticking from debris or contamination, a particular disadvantage with the ball valve construction is that the ball 48 is unstable and is capable of lateral movement within the bore 38 as shown by arrows A and B. The unstable ball 48 begins to vacillate in response to the high-pressure oil flowing past the ball 48. Such vacillation agitates the oil, which causing aeration, i.e., air or other gases mixing with the oil, and decreases the cooling and lubricating effect of the oil.

Another oil jet configuration is a piston valve construction, shown in FIG. 3. A piston valve 52 comprises a tubular sleeve 32 connected at one end to an oversized head 40. The sleeve 32 further includes a pair of oil exiting apertures 36 at its lower end, which communicate with nozzles of an oil jet body. A bore 38 extends through the head 40 and sleeve 32 to form a passage for oil entering the piston valve 52. At the end opposite the head 40 and below the oil exiting apertures 36, the bore 38 tapers to create a seat 42 that is in fluid communicates with an oil entrance opening 44.

A spring 46 is held within the bore 38 that biases a piston 54 against the seat 42 to close the valve. A cap 50 is placed over the bore 38 at the head 40 to retain the spring 46 within the sleeve 32. When the oil pressure rises above a predetermined value, the pressurized oil overcomes the biasing force of the spring 46 to depress the spring 46 and move the piston 54, which opens the valve. When the piston 54 is moved to open the valve, the pressurized oil flows into the bore 38. As the pressurized oil enters the bore 38, it passes through the oil exiting openings 36 as indicated by the arrows Y and X of FIG. 3. Because the oil exiting openings 36 are in fluid communication with nozzles of the oil jet body, the oil is directed onto the pistons. When the oil pressure falls below a predetermined value, the spring 46 biases the piston 54 against the seat 42 to close the valve.

The piston valve design generally reduces the agitation and aeration; however, the piston valve design is more susceptible to sticking from debris or contamination and is much more costly to produce.

Therefore, there is need in the art to create a stable fluid jet that is more cost effective to manufacture and less labor intensive to produce while also being less susceptible to sticking from debris or contamination.

SUMMARY OF INVENTION

An oil jet assembly includes a main body, a tube, a cap insert, a ball, and a spring. The main body includes a bore that passes longitudinally through the main body; a tube aperture that passes through the main body near a first end of the main body; and an opening at a second and opposite end of the main body. The tube is attached to the main body and is in fluid communication with the tube aperture. The cap insert is positioned within the bore of the main body. The cap insert includes a bore that passes longitudinally through the cap insert and forms a wall. The cap insert also includes an oil exit aperture passing though the wall that is in fluid communication with the bore of the main body. The ball and spring are positioned within the bore of the insert cap. The spring is positioned between the ball and the first end of the main body.

DESCRIPTION OF THE DRAWINGS

Objects and advantages together with the operation of the invention may be better understood by reference to the following detailed description taken in connection with the following illustrations, wherein like numerals indicate like elements throughout, and wherein.

DETAILED DESCRIPTION

While the present oil jet is described with reference to an exemplary embodiment described herein, it should be clear that the present oil jet should not be limited to such an embodiment. Therefore, the description of the embodiment provided herein is illustrative of the present invention and should not limit the scope of the invention as claimed.

Figure 1:
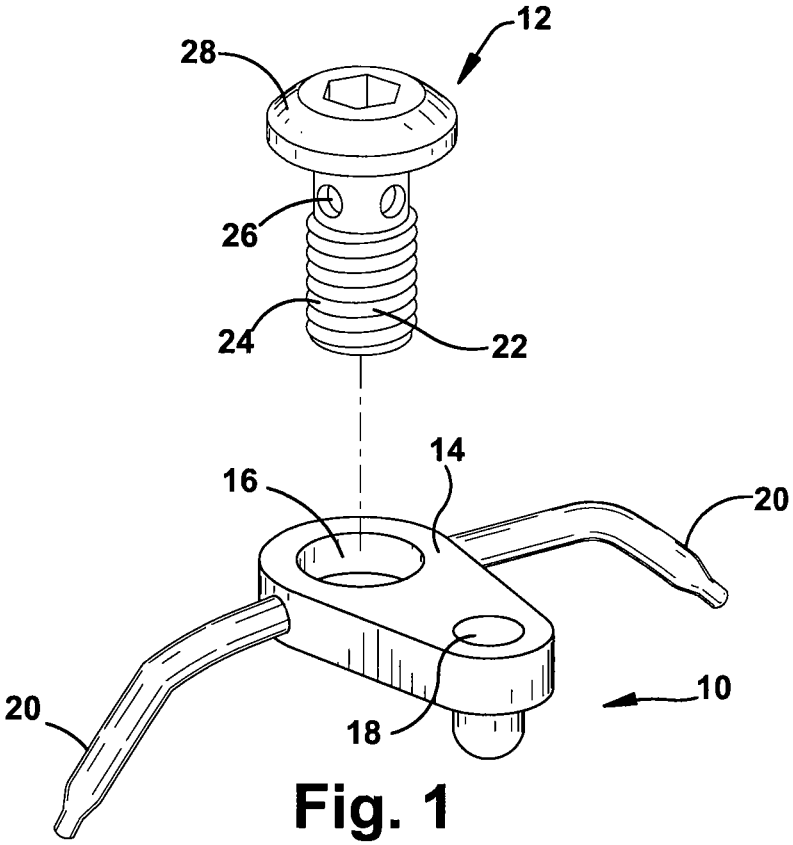
Fig. 1 (Prior Art)
FIG. 1 is an exploded view of a known oil jet valve and oil jet body.
Figure 1A:
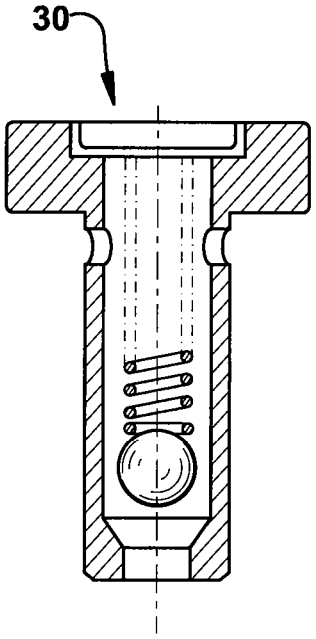
Fig. 1A (Prior Art)
FIG. 1A is a cross-sectional view of a known oil jet valve of a ball-type check valve.
Figure 1B:
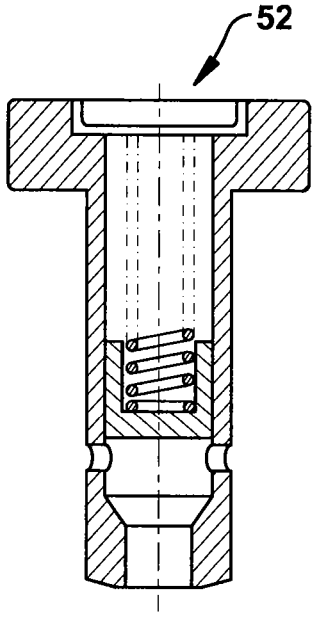
Fig. 1B (Prior Art)
FIG. 1B is a cross-sectional view of a known oil jet valve of the piston valve type.
Figure 2:
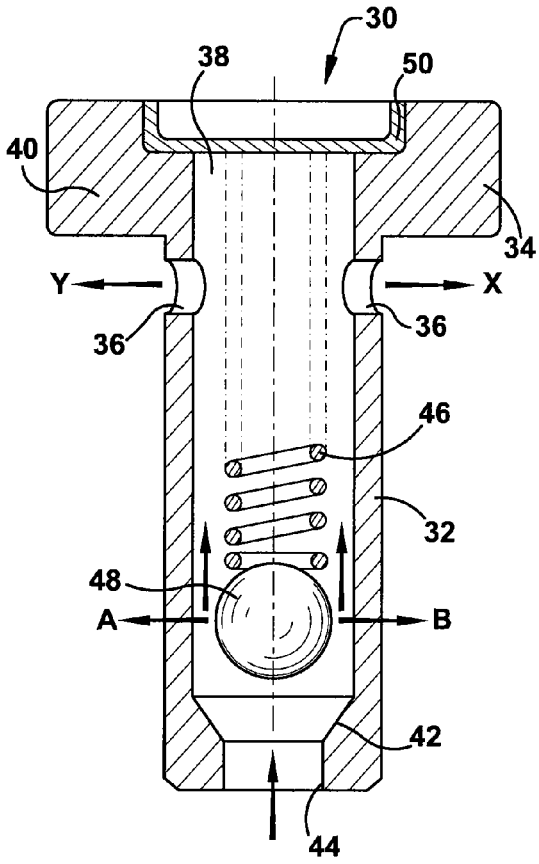
Fig. 2 (Prior Art)
FIG. 2 is a cross-sectional view of a known oil jet valve of a ball-type check valve.
Figure 3:
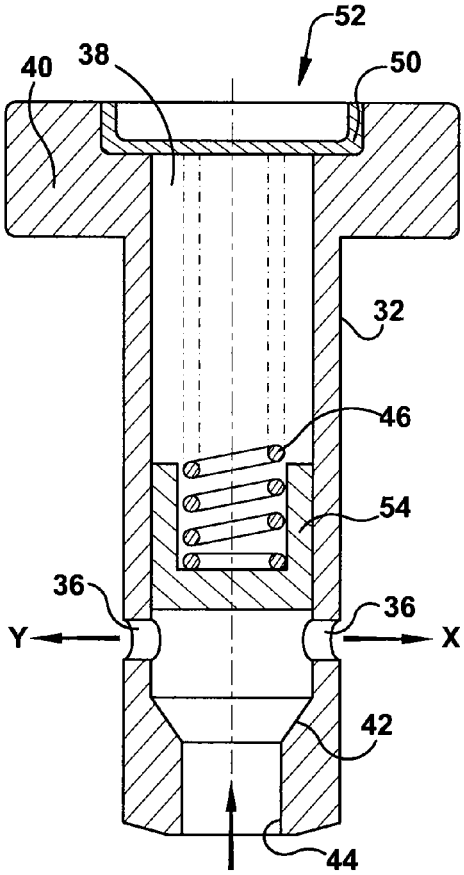
Fig. 3 (Prior Art)
FIG. 3 is a cross-sectional view of a known oil jet valve of the piston valve type.
Figure 4:
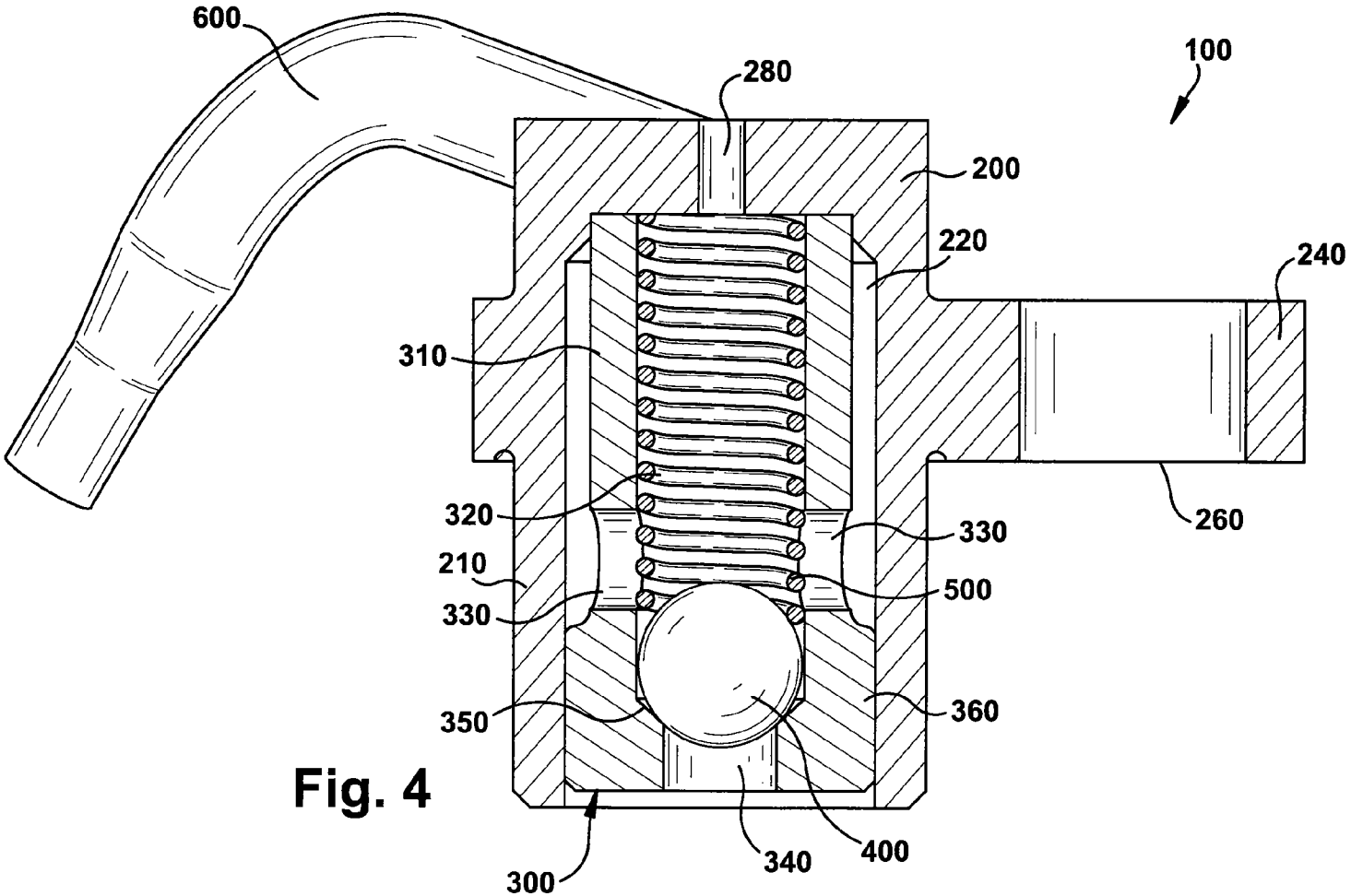
FIG. 4 is a cross-sectional view of an assembled oil jet.
Figure 5:
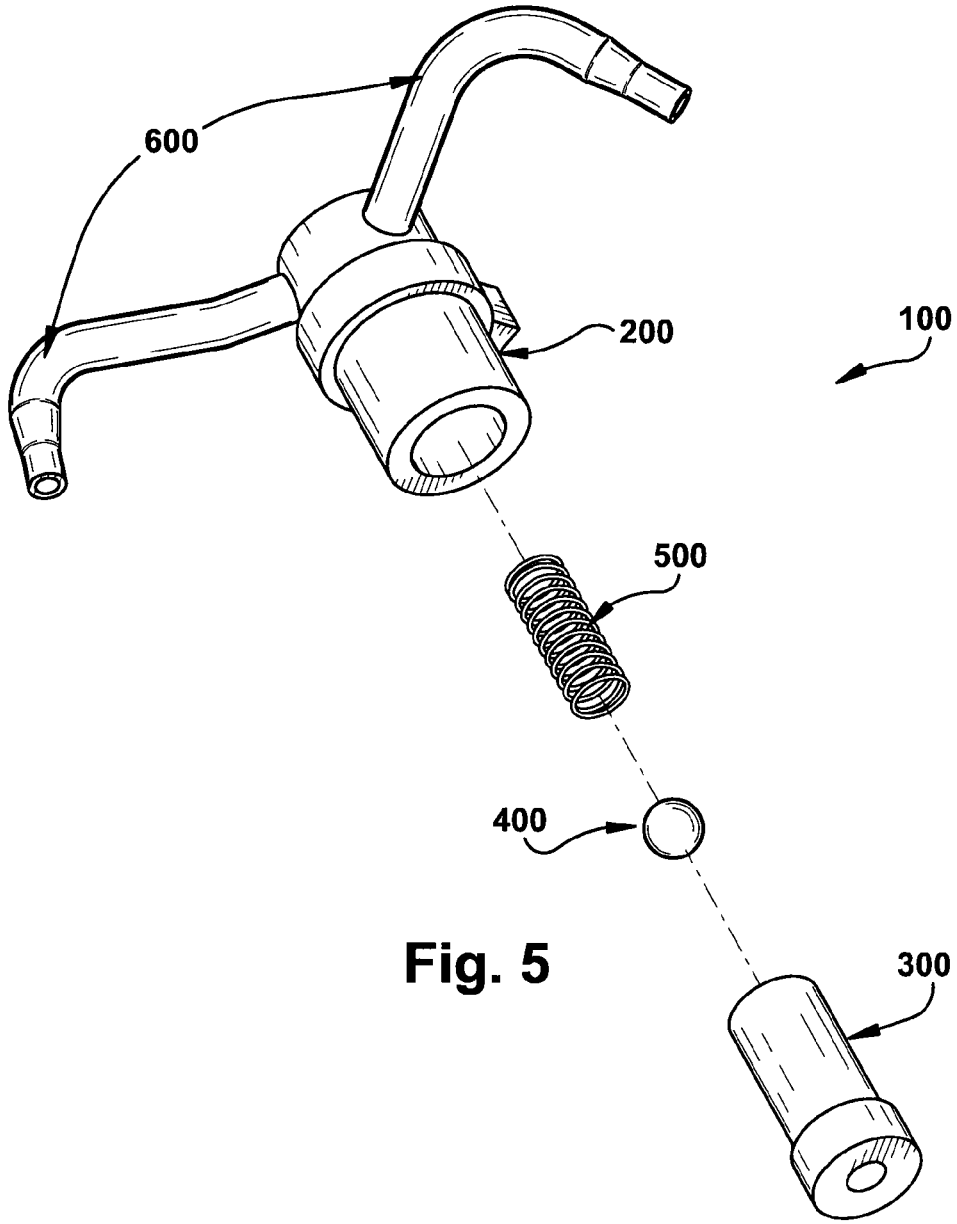
FIG. 5 is an exploded view of an oil jet.
Figure 6:
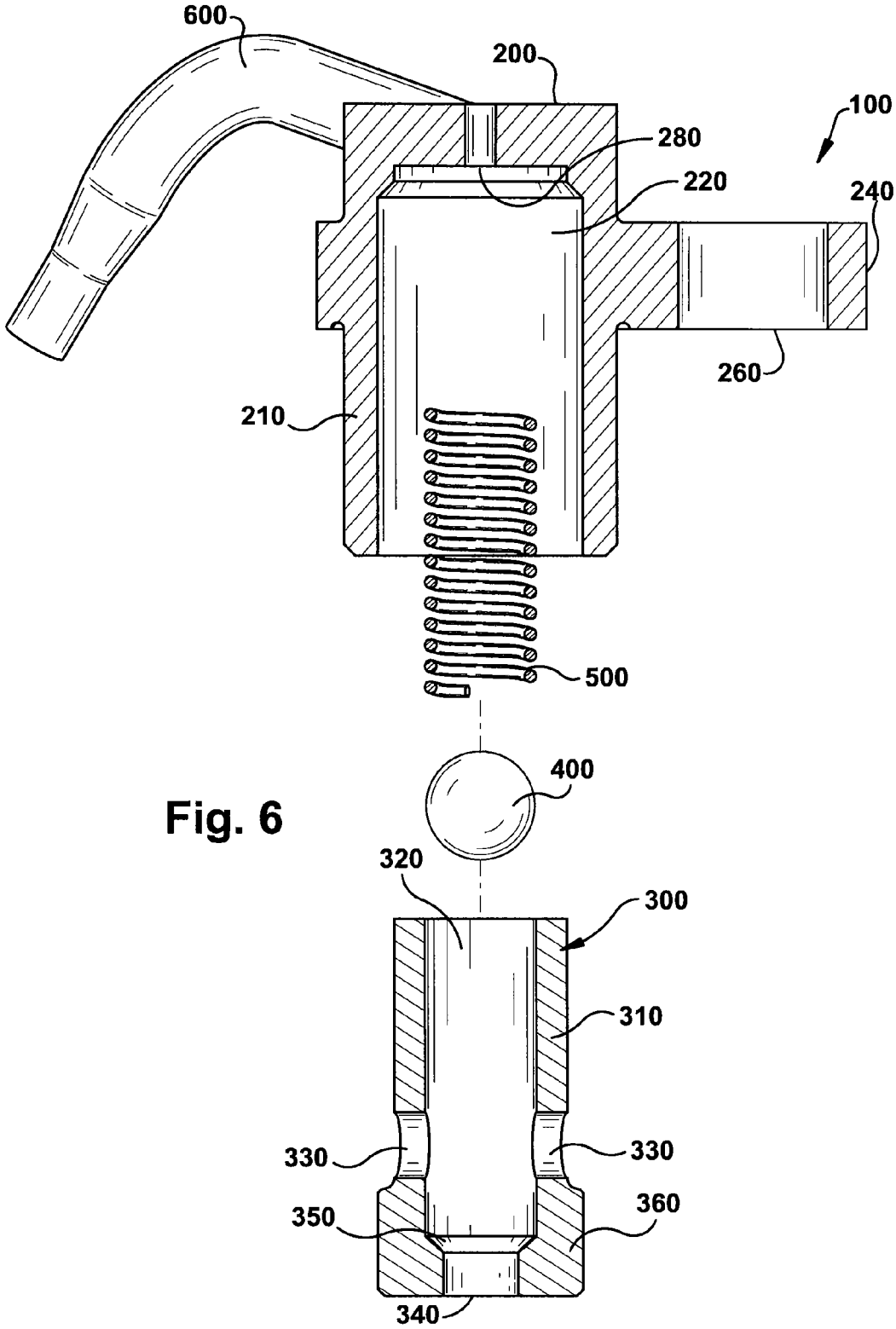
FIG. 6 is a cross-sectional exploded view of the oil jet.

An exemplary embodiment of an oil jet 100 is illustrated in FIGS. 4-6. The oil jet 100 may be arranged to provide oil to the underside of one or more reciprocating pistons in an engine. The oil may be delivered to the pistons when the oil pressure of the engine exceeds a predetermined threshold. The oil may cease to be delivered to the pistons when the oil pressure of the engine falls below the predetermined threshold. The oil jet 100 may include a main body 200, an insert cap 300, a ball 400, a compression spring 500, and one or more tubes 600.

The main body 200 may be a one-piece component constructed from a powdered metal process or a metal injection molding process. The main body 200 includes a base 210. The base 210 is illustrated with a generally circular cross-section; however, it will be understood that the base 210 may have other cross-sectional shapes. The main body 200 also includes a central cavity 220 for receiving the insert cap 300, and a mounting tab 240 having a mounting aperture 260 for mounting the oil jet 100 to the underside of an engine block (not shown). The main body 200 may include one or more tube apertures 280 disposed about the perimeter of the main body 200 and in communication with the central cavity 220.

As will be described in greater detail below, one or more tubes 600 may be coupled or otherwise attached to the main body 200. Such tubes 600 may be in fluid communication with a corresponding tube aperture 280 so that the central cavity 220 is in fluid communication with each tube 600. The tubes 600 may be coupled or attached to the main body 200 by any suitable means, including but not limited to welding, brazing, adhesive, or mechanical fasteners. In addition, the tubes 600 may be molded as an integral feature of the main body 200. The tubes 600 may be arranged to direct oil passing through the central cavity 220 and exiting the tube apertures 280 to one or more desired locations, such as the underside of one or more reciprocating pistons of the engine.

Figure 7A:
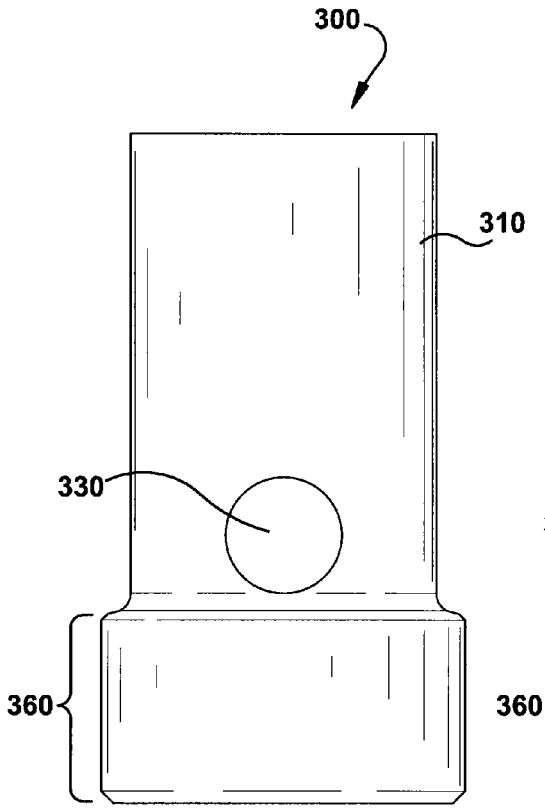
FIG. 7A is a side view of a cap insert.
Figure 7B:
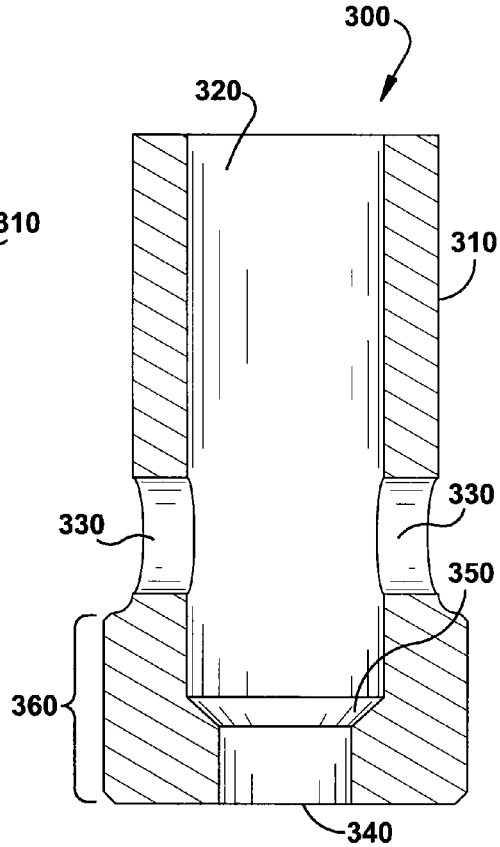
FIG. 7B is a cross-sectional view of an insert cap.

The cap 300 may be coaxially disposed within the central cavity 220 of the main body 200. The cap 300 may be constructed from any suitable material, including but not limited to metal, polymer, or composite. As seen in FIGS. 7A and 7B, the cap 300 includes an outer wall 310 that defines a central bore 320. One or more oil exiting apertures 330 are disposed about the wall 310 for provide fluid communication between the central bore 320 and central cavity 220 of the main body 200. The cap 300 also includes an oil entrance opening 340 that provides for fluid communication between the central bore 320 and an oil line (not shown). The end of the bore 320 nearest the oil entrance opening 340 tapers to create a seat 350. The cap 300 also includes a sealing region 360 having an outer diameter that is both greater than the diameter of the remainder of the cap 300 and substantially similar to the diameter of the main body central cavity 220. Such an arrangement may form a seal between the cap 300 and the main body 200 when the cap 300 is secured to the main body 200 by suitable means, including but not limited to welding, brazing, adhesive, or mechanical fasteners.

With particular reference to FIGS. 4 and 6, the fluid pressure actuated valve configuration of illustrative oil jet 100 generally comprises the ball 400 and compression spring 500 arranged within the oil jet 100. The ball 400 and compression spring 500 are disposed within the bore 320 of the cap 300. The spring 500 extends between the terminal end of the central cavity 220 of the main body 200 and the ball 400 as best seen in FIG. 4. Such a valve configuration may be moveable between a closed position and an open position. The valve configuration moves between the closed and open position depending on the pressure applied by the oil in the engine. When the oil pressure is of the engine is less than the predetermined threshold oil pressure, the valve is closed. Conversely, when the oil pressure of the engine is above the predetermined threshold, the valve is open. The spring 500 has a spring constant such that when the pressure generated by the spring 500 is greater than the oil pressure at the oil entrance opening 340 of the cap 300 (e.g. the oil pressure is less than the predetermined threshold), the ball 400 remains biased against the seat 350 of the cap 300 and oil is not permitted to enter the oil jet 100. When the pressure generated by the spring 500 is less than the oil pressure at the oil entrance opening 340 of the cap 300 (e.g. the oil pressure exceeds the predetermined threshold), the spring 500 is depressed, the ball 400 is moved, and oil is permitted to pass into the oil jet 100. Such a configuration provides a cost-effective oil jet that has a reduced susceptibility to sticking due to debris and a reduced susceptibility to agitation and aeration.

The oil jet 100 may be coupled to the underside of an engine block via a fastener passed through the mounting aperture 260 in the mounting tab 240 of the main body 200. In such an arrangement, each tube 600 may be positioned to direct oil to a desired location such as the underside of one or more reciprocating pistons. Such positioning may be achieved by bending of the tubes in a secondary process. When the engine is operating, pressurized oil may be supplied to the oil entrance opening 340 of the cap 300 by an oil line secured about the perimeter of the main body 200. As described above, when engine oil pressure is less than the predetermined threshold, the ball 400 and spring 500 act the prevent oil from passing from the oil line into the oil jet 100. However, when engine oil pressure exceeds the predetermined threshold, the spring 500 is depressed and the ball 400 moves to permit oil to pass through the oil entrance opening 340 of the cap 300. Oil then flows into the cap bore 320, through the oil exiting apertures 330 of the cap 300 and into the main body central cavity 220. From the main body central cavity 220, oil passes through the tube apertures 280 of the main body 200, into the tubes 600, and exits the tubes 600 to be sprayed on the desired locations.

Figure 8:
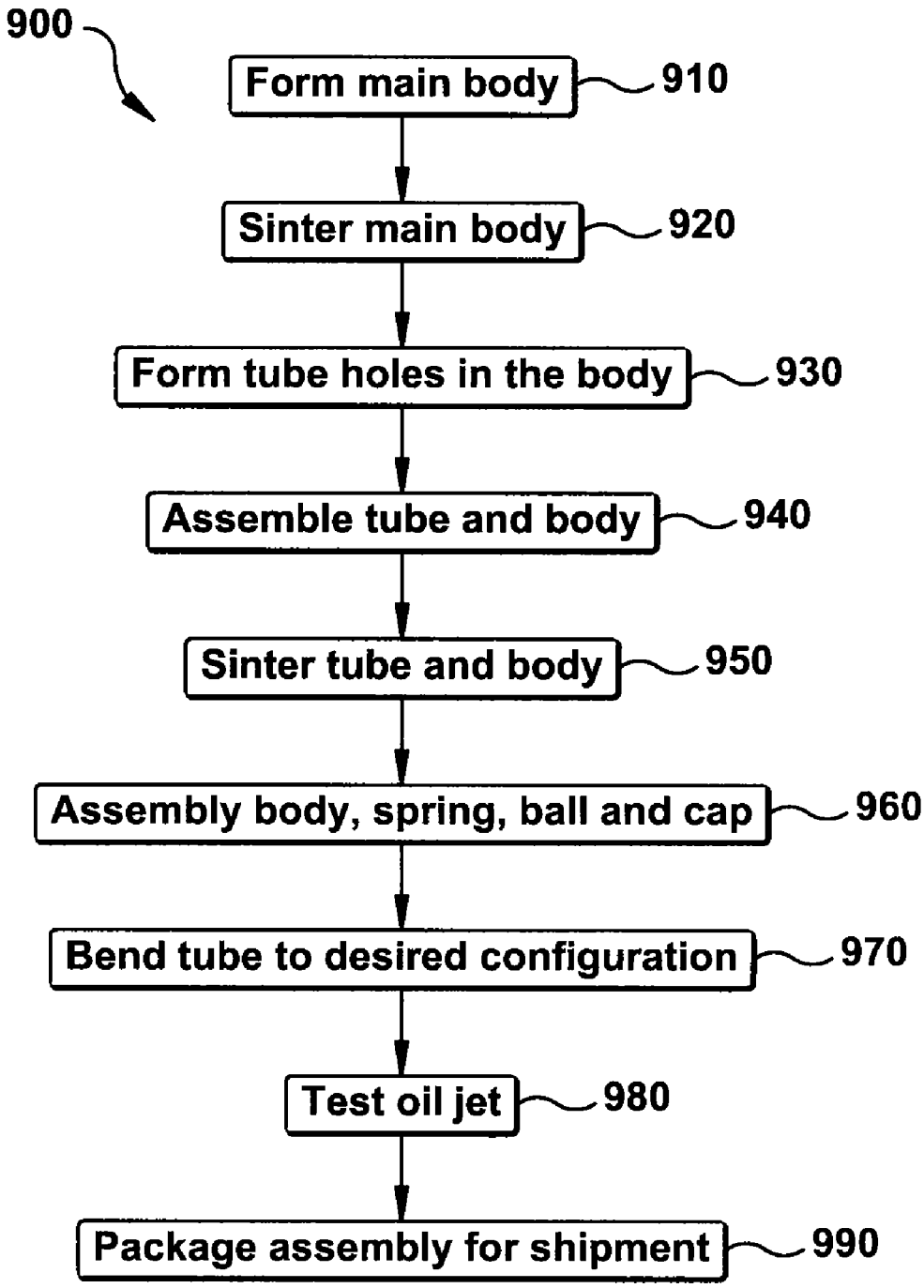
FIG. 8 is a process flow diagram for manufacturing an oil jet.

The oil jet 100 may be manufactured using a number of methods and processes. An exemplary manufacturing process is illustrated by flow diagram 900 in FIG. 8. First, powdered metal is injected into a mold 910 or passed through a die to produce a cohesive structure very near the dimensions of the illustrative main body described above. Next, the molded structure is sintered 920, or otherwise formed by applied pressure, high temperature, long setting times, or any combination thereof, to provide a cohesive main body as previously illustrated. Tube holes are then drilled 930, or otherwise formed, in the main body.

Next, one or more tubes are provided to the outer surface of the main body at the desired locations (e.g. about respective tube holes) and the tubes are assembled to the main body 940. For example, brazing paste may be applied to the tubes and/or main body and the tube positioned adjacent to the main body. The main body and tubes are then sintered 950, or otherwise coupled together by applied pressure, high temperature, long setting times, or any combination thereof, to provide a cohesive main body and tube assembly. Next, the ball and spring are disposed within the cap, and the cap then disposed within the main body such that the spring extends between the ball and the terminal end of the main body cavity 960. The tubes may be optionally bent so they each aim in the desired direction 970. The oil jet then undergoes initial testing of proper valve function, proper targeting of the tubes and the like 980. Finally, the oil jet is packed for shipping 990.

In another exemplary embodiment, an oil jet may be manufactured by a metal injection molding process. In one embodiment of the metal injection molding process, powdered metal is combined with binding material. The combined materials are injected into a mold by an injection-molding machine. Once the component is molded, the binder may be removed from the molded component through the use of solvents and thermal processing. Once the binder is sufficiently removed, the component may be placed under pressure at an elevated temperature to complete the component.

Figure 9:
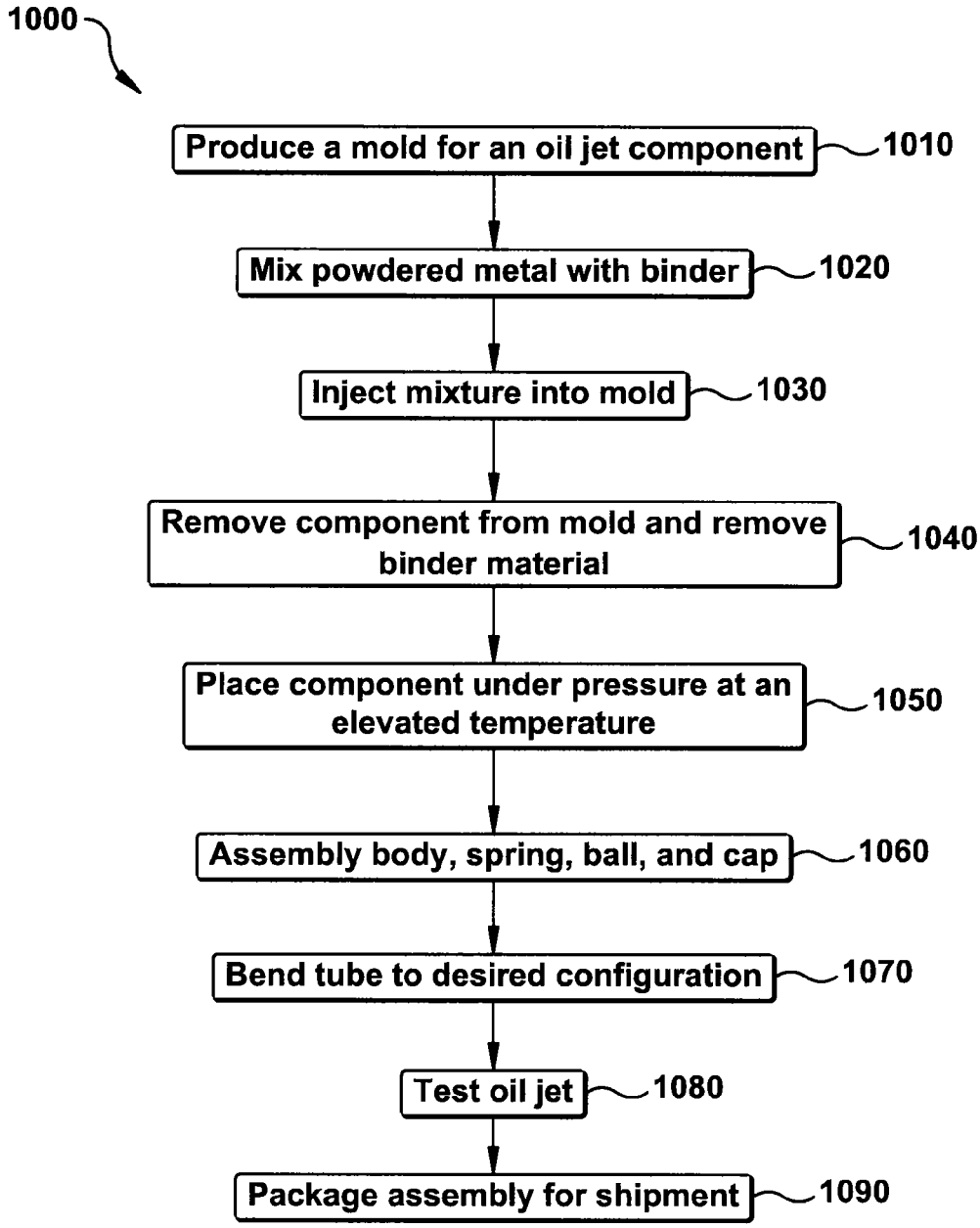
FIG. 9 is a process flow diagram for manufacturing an oil jet.

An exemplary manufacturing process using metal injection molding is illustrated by flow diagram 1000 in FIG. 9. First, a mold for an injection molding process is produced 1010. The mold is designed to provide an oil jet with intricate features. Powdered metal is mixed with binder 1020. The mix of powdered metal and binder is injected into the mold 1030. The molded component is removed from the injection mold and the binder is removed from the component 1040. The component is placed under pressure at an elevated temperature to produce a near shape main body with tubes and internal features 1050. The ball and spring are disposed within the main body, and the cap then disposed within the main body such that the spring extends between the ball and the terminal end of the main body cavity 1060. The tubes may be optionally bent so they each aim in the desired direction 1070. The oil jet then undergoes initial testing of proper valve function, proper targeting of the tubes and the like 1080. Finally, the oil jet is packed for shipping 1090.

Figure 10:
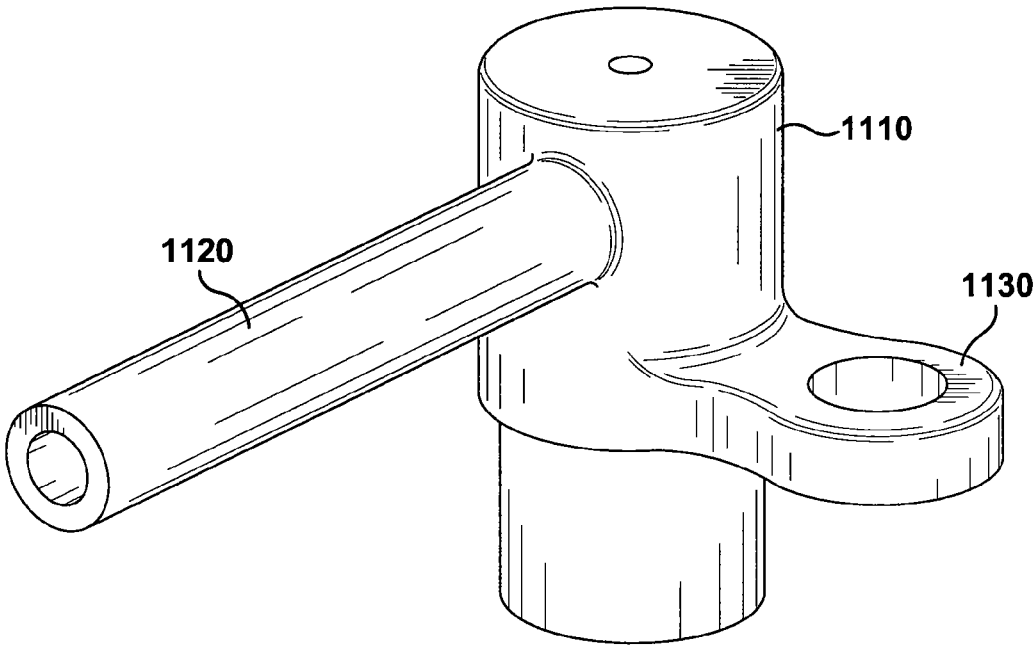
FIG. 10 is a perspective view of a main body of an oil jet with an integrated tube and mounting tab.
Figure 11:
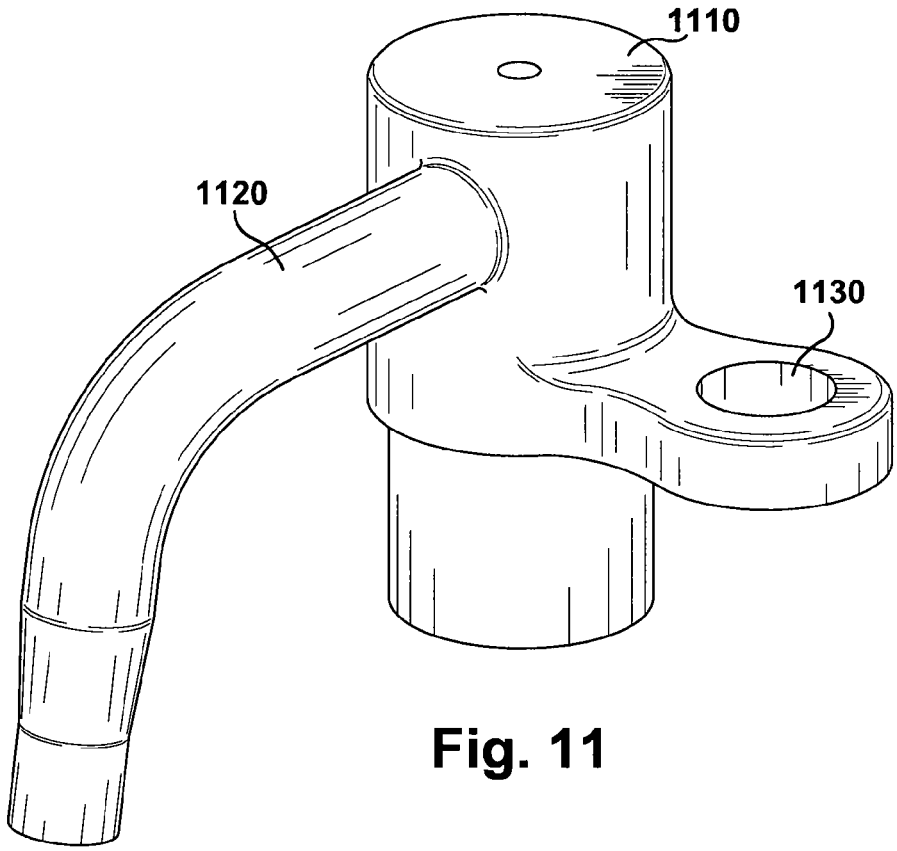
FIG. 11 is a perspective view of a main body of an oil jet with an integrated tube and mounting tab.
Figure 12:
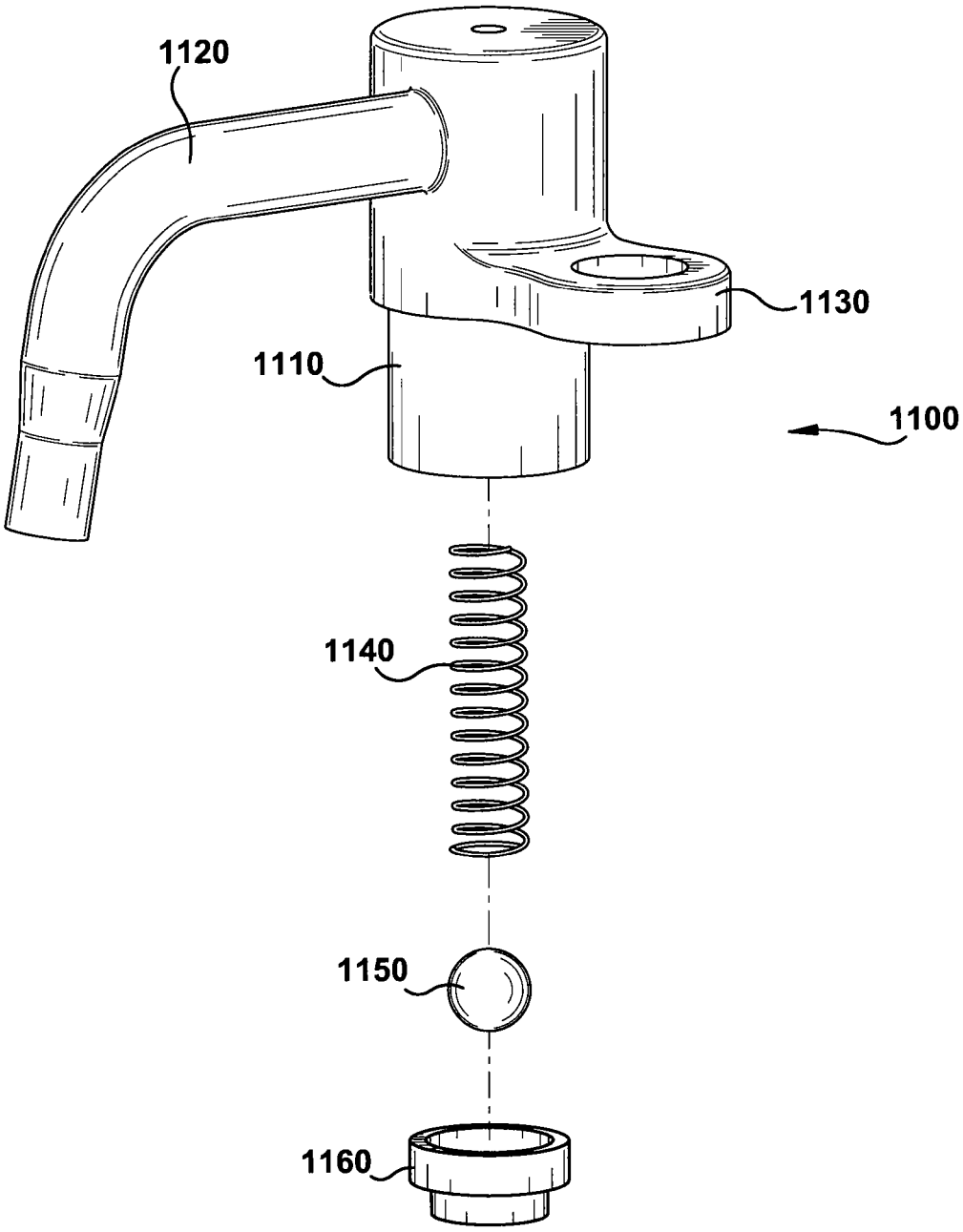
FIG. 12 is an exploded view of an oil jet.

As illustrated in FIGS. 10-12, an oil jet 1100 may be manufactured so that the main body 1110, mounting tab 1120, and tube 1130 are integral, i.e., one continuous component. One method of manufacturing such a component is metal injection molding. In such an arrangement, the spring 1140 and ball 1150 are separate components to be assembled with the main body 1110. The cap 1160 as compared to earlier descriptions includes only a seat against which the ball 1150 may be biases to close the valve. The remaining features of the oil jet 1100 are molded into the interior of the main body 1110. For example, a passage or bore for containing the spring 1140 and ball 1150, oil exiting apertures, and tube apertures for channeling the oil when the valve is open may all be integral in the main body 1110. Such an arrangement allows for intricate features to be molded to a net shape, leading to cost savings in reducing the number of secondary operations.

The invention has been described above and, obviously, modifications and alternations will occur to others upon a reading and understanding of this specification. The claims as follows are intended to include all modifications and alterations insofar as they come within the scope of the claims or the equivalent thereof.

Having thus described the invention, we claim:

1. An oil jet assembly comprising:

a main body including:

a main body bore passing longitudinally through at lest a portion of the main body and including an inner sidewall; and a tube aperture passing though the main body proximate to a first end of the main body and in fluid communication with the main body bore;

a tube attached to the main body and in fluid communication with the tube aperture;

a cap insert positioned within the main body bore through an opening at a second end of the main body, where the second end is located opposite of the first end of the main body, the cap insert including:

a cap insert bore passing longitudinally through the cap insert, where the cap insert forms a sidewall about the bore;

an oil exit aperture passing though the cap insert sidewall and in fluid communication with the main body bore when the cap insert is positioned within the main body bore; and a space between the cap insert wall and the main bore inner sidewall to provide fluid communication between the oil exit aperture and the tube aperture;

a ball positioned at least partially within the insert cap bore; and a biasing member positioned at least partially within the insert cap bore between the ball and the first end of the main body.

2. The oil jet assembly of claim 1, where the cap insert further includes a seal portion comprising a portion of the cap insert wall.

3. The oil jet assembly of claim 2, where the seal portion is located distal the first end of the main body when the insert cap is positioned within the main body bore.

4. The oil jet assembly of claim 3, where the oil exit aperture is located closer to the seal portion than the first end of the main body when the cap insert is positioned within the main body bore.

5. The oil jet assembly of claim 2, where the seal portion is positioned adjacent to an inner surface of the main body bore to seal the main body bore.

6. The oil jet assembly of claim 1, further comprising a mounting tab attached to the main body.

7. The oil jet assembly of claim 6, where the mounting tab includes a mounting aperture.

8. The oil jet assembly of claim 1, where the insert cap bore includes a reduced area to interact with the ball to seal the insert cap bore.

9. The oil jet assembly of claim 1, where the ball is moveable to selectively allow fluid communication between the insert cap bore and the main body bore through the oil exit aperture.

10. The oil jet assembly of claim 1, where the biasing member is a spring that biases the ball towards the second end of the main body.

11. An oil jet assembly comprising:

a main body including:

a central bore passing longitudinally through the main body, the central bore including an inner sidewall;

a tube aperture passing though the main body proximate to a first end of the main body;

a tube extending from the body in fluid communication with the tube aperture;

an oil exit aperture formed in a wall of the central bore and in fluid communication with the tube aperture; and an opening at a second end of the main body located opposite the first end of the main body;

a cap insert positioned within the central bore proximate to the second end of the main body and spaced away from the central bore inner sidewall, the cap insert including an oil entry aperture formed in a sidewall of the cap insert and in fluid communication with the central bore;

a ball positioned within the central bore; and a biasing member positioned within the central bore between the ball and the first end of the main body.

12. The oil jet assembly of claim 11, where the main body is formed by a metal injection molding process.

13. The oil jet assembly of claim 11, where the ball is moveable to selectively allow fluid communication between the oil entry aperture and the tube aperture.

14. The oil jet assembly of claim 11, where the biasing member is a spring that biases the ball towards the second end of the main body.

* * * * *